US006517125B2

(12) United States Patent
Brisco

(10) Patent No.: US 6,517,125 B2
(45) Date of Patent: Feb. 11, 2003

(54) CEMENTING HEAD

(75) Inventor: David P. Brisco, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/929,790

(22) Filed: Aug. 14, 2001

(65) Prior Publication Data

US 2001/0050105 A1 Dec. 13, 2001

Related U.S. Application Data

(62) Division of application No. 09/238,464, filed on Jan. 28, 1999.

(51) Int. Cl.[7] ..... F16L 17/00; F16L 19/00
(52) U.S. Cl. ..... 285/363; 285/420
(58) Field of Search ..... 285/420, 363

(56) References Cited

U.S. PATENT DOCUMENTS

| | | | | | |
|---|---|---|---|---|---|
| 1,662,311 | A | * | 3/1928 | Hamer | 166/70 |
| 1,866,726 | A | * | 7/1932 | Santiago | 285/104 |
| 2,569,857 | A | | 10/1951 | Jaegle et al. | 137/111 |
| 2,649,314 | A | * | 8/1953 | Richardson | 285/33 |
| 3,997,197 | A | * | 12/1976 | Marsh et al. | 285/93 |
| 4,093,283 | A | * | 6/1978 | Weinhold | 285/243 |
| 4,246,967 | A | * | 1/1981 | Harris | 166/291 |
| 4,290,482 | A | | 9/1981 | Brisco | 166/70 |
| 4,522,430 | A | * | 6/1985 | Stromberg | 285/24 |
| 4,524,998 | A | | 6/1985 | Brisco | 285/101 |
| 4,574,882 | A | | 3/1986 | Szarka | 166/75.1 |
| 4,613,161 | A | | 9/1986 | Brisco | 285/18 |
| 4,624,312 | A | | 11/1986 | McMullin | 166/155 |
| 4,671,353 | A | | 6/1987 | Daming | 166/70 |
| 4,775,008 | A | | 10/1988 | Cameron | 166/70 |
| 4,917,184 | A | | 4/1990 | Freeman et al. | 166/285 |
| 4,995,457 | A | | 2/1991 | Baldridge | 166/70 |
| 5,040,603 | A | | 8/1991 | Baldridge | 166/290 |
| 5,050,673 | A | | 9/1991 | Baldridge | 166/70 |
| 5,095,808 | A | | 3/1992 | Baldridge | 92/24 |
| 5,129,689 | A | | 7/1992 | Newski et al. | 285/333 |
| 5,236,035 | A | | 8/1993 | Brisco et al. | 166/70 |
| 5,293,933 | A | | 3/1994 | Brisco | 166/70 |
| 5,441,310 | A | | 8/1995 | Barrett et al. | 285/18 |
| 5,443,122 | A | | 8/1995 | Brisco | 166/285 |
| 5,605,358 | A | | 2/1997 | Mohkenkamp | 285/39 |
| 5,967,231 | A | | 10/1999 | Laurel et al. | 166/250.04 |
| 6,302,140 | B1 | * | 10/2001 | Brisco | 137/268 |

FOREIGN PATENT DOCUMENTS

| | | | |
|---|---|---|---|
| WO | WO 98/48143 | 10/1998 | E21B/33/13 |

OTHER PUBLICATIONS

Halliburton Energy Services, Inc. Brochure "Casing Circulating Equipment" dated Apr., 1997 (2 pages).

Plug Container shown in Halliburton Sales and Service Catalog No. 39, p. 3138. (undated but admitted to be prior art).

Manifold shown in Halliburton Casing Sales Manual No. 820.00005. p. 3–12 (undated but admitted to be prior art).

* cited by examiner

*Primary Examiner*—Robert J. Sandy
*Assistant Examiner*—Carlos Lugo
(74) *Attorney, Agent, or Firm*—John W. Wustenberg; Craig W. Roddy; Anthony L. Rahhal

(57) ABSTRACT

A cementing head is provided for introduction and separation of fluids in a well. The cementing head comprises a plug container having upper and lower fluid inlets oriented tangent to the bore of the plug container. The upper inlet is located below the upper end of the plug so that a compact manifold can be used therewith. The compact manifold includes first and second discharge tees which may be connected by a one-piece coupling such that rotation of the coupling in one direction causes the discharge tees to seal against a spacer therebetween and rotation in a second direction causes the discharge tees to move apart from one another. A coupling for quick coupling of the plug container to a casing collar is also provided. The coupling apparatus comprises a locking clamp having pivotally connected arcuate clamp portions. Each arcuate clamp portion engages a lower end of a casing collar. A threaded adjustment is provided for increasing an initial compression of a seal against the upper end of the casing collar.

9 Claims, 10 Drawing Sheets

CEMENTING HEAD

Related U.S. Application Data

This application is a divisional of co-pending application Ser. No. 09/238,464, filed on Jan. 28, 1999.

BACKGROUND OF THE INVENTION

This invention relates to cementing heads used for the introduction and separation of fluids in a well, such as the introduction and separation of a cement slurry. Specifically, the invention relates to plug containers, manifolds and quick-latch couplers. As is well known in the art, cementing plugs utilized to separate fluids passing through casing in a wellbore are often held in a plug container. Rather than opening the top of the casing to insert cementing plugs, a plug container is installed at the top of the casing. The plug container has flow lines attached thereto and may have a quick-latch coupler connected thereto, which can be utilized to attach the plug container to the casing. The plug container may also have a manifold attached thereto which directs fluid into the plug container. A typical prior art plug container is shown in Halliburton Sales & Service Catalog No. 39, page 3138. A typical manifold is shown in Halliburton Casing Sales Manual No. 820.00005, pg. 3–12. Prior art quick-latch couplers are shown in U.S. Pat. Nos. 4,524,998 and 4,613,161 assigned to the assignee herein, both of which are incorporated in their entirety herein by reference.

At the beginning of a typical cementing job, the well casing and the well borehole are usually filled with drilling mud. To reduce the contamination at the interface between drilling mud and the cement which is pumped into the well casing on top of the drilling mud, a bottom cementing plug is often pumped ahead of the cement slurry so that the interface between the cement slurry and the drilling mud already in the well casing is defined by the bottom cementing plug.

As the cement is pumped into the well casing, the bottom cementing plug is pumped down the well casing. The bottom plug serves the function of wiping mud from the walls of the casing ahead of the cement slurry reducing dilution of the cement slurry, and serves to minimize contamination of cement as it is being pumped down the casing string. To separate the displacing fluid used to push the cement slurry out the tubular string and up the annular space, a top cementing plug is placed in line and pushed down the string by the displacing fluid. Typically, the bottom cementing plug is loaded into the plug container prior to pumping cement, and the top cementing plug will be loaded after the bottom plug is released. There may be times when only one cementing plug is used. In those cases, the plug is released after the cement to push the slurry out the tubular string. If well conditions dictate, a multiple plug container may be used which allows both cementing plugs to be released when desired without opening the plug container. Whether a single or multiple plug container is used, it can either be a free-fall or manifold type plug container.

The manifold utilized with plug containers is typically connected to inlets in the side of the plug container and is valved so that fluid can be displaced ahead of and behind cementing plugs. Often, the plug container and manifold may be made up as much as thirty feet off the rig floor. Because of the size, shape and weight of the plug and manifold assembly, it is difficult, time consuming and sometimes dangerous to make up the plug container, manifold and casing. Thus, there is a need for shorter and lighter plug containers, and more compact manifolds which are more maneuverable and easier and safer to handle.

Short plug container length is also important where rigs have short bales leaving little vertical distance above the top of the casing in which to make up the plug container. It is also desirable on some occasions to provide a means for quickly connecting the plug container to a casing collar in some manner other than making a threaded connection to a casing collar. Coupling apparatus for quick connection are shown in U.S. Pat. Nos. 4,613,161 and 4,524,998. While such apparatus work well, there is still a need for a shorter, more compact coupling apparatus that is easy to assemble. The present invention provides compact plug containers and manifolds which make assembly easier and make the cementing head easier to handle, and also provides a compact, readily assembled coupling apparatus.

SUMMARY OF THE INVENTION

The present invention provides a cementing head which is compact, maneuverable and easily assemblable. The cementing head of the present invention includes a plug container having first, or upper and second, or lower fluid inlets oriented 90° from a longitudinal central axis of the plug container and offset therefrom. Thus, fluid entering the plug container creates a flow vortex which will draw plugs in the container down into the casing string. A manifold may be connected to the plug container.

The manifold includes a first valve connected to the upper inlet of the plug container and a second valve connected to the lower inlet of the plug container. A first discharge tee is connected to the first valve and a second discharge tee is connected to the second valve. The first and second discharge tees are connected to one another with a closing nut which is preferably a one-piece closing nut. The closing nut will engage threads on the first and second discharge tees such that rotation of the closing nut in one direction will cause the discharge tees to move toward one another and tighten against a spacer disposed therebetween to create a fluid-tight connection. Rotation of the closing nut in a second direction will cause the space between the first and second tees to increase and loosen the seal against the spacer.

The first discharge tee may have a left-hand thread defined thereon and the second discharge tee may have a right-hand thread defined thereon. The closing nut will have corresponding left- and right-hand threads defined on corresponding first and second ends thereof to engage the first and second discharge tees. The manifold has a fluid inlet which can be connected to a fluid supply line, the valves in the manifold can be manipulated to direct flow to the upper or lower inlets of the plug container.

A multiple plug container is also disclosed. The multiple plug container of the present invention has a plug container body with sufficient length to hold a top and a bottom cementing plug. The multiple plug container of the present invention has only two fluid inlets. Thus, the manifold may be connected to the upper and lower fluid inlets such that the multiple plug container is a combination free-fall manifold plug container. In other words, the manifold can be manipulated such that flow is directed through the upper inlet in the plug container on top of the bottom plug. The top plug, however, is necessarily a free-fall plug. The inlets in the multiple plug container are oriented 90° to the longitudinal central axis thereof and offset therefrom such that a flow vortex is created in the plug container body which will draw the top plug into the flow stream.

A coupling apparatus for connecting the plug container to a casing string is also provided. The coupling apparatus comprises a body having threads defined thereon and a bore defined therethrough. A seal is disposed in the bore and is designed to seal against the upper end of a casing received in the bore. A locking clamp is disposed about the body. The locking clamp has a radially inwardly extending lip at a lower end thereof.

The locking clamp comprises first and second arcuate clamp portions hingedly connected to one another and movable between open and closed positions. Each arcuately shaped clamp portion has the radially inwardly extending lip at a lower end thereof.

When the locking clamp is in the closed position, the lip is closely received about the outer diameter of the casing below the lower end of a casing collar attached to the upper end of the casing. The lip defines an upward facing annular surface which will engage a downward facing annular surface defined by the casing collar, which may be referred to as an enlarged diameter portion of the casing. Rotation of the clamp once it is in the closed position will cause the casing to move longitudinally relative to the body, and will cause an initial compression of the seal disposed in the bore of the body to increase. A limit ring is provided for limiting the opening movement of the arcuate clamp portions. A latch means is provided for latching the locking clamp in its open or closed positions.

As will be more fully described herein, the plug containers, manifolds and coupling devices of the present invention may be used together in a number of combinations. Plug containers, manifolds and coupling devices of the present invention provide for a more compact, maneuverable and readily assemblable cementing head such that the installation of the cementing head at a substantial height off the rig floor is less burdensome and dangerous than with prior art cementing heads. Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 6 is a sectioned view taken 90° from the view of FIG. 5B.

DETAILED DESCRIPTION OF A PREFERRED EMBODIMENT

Figure 1:
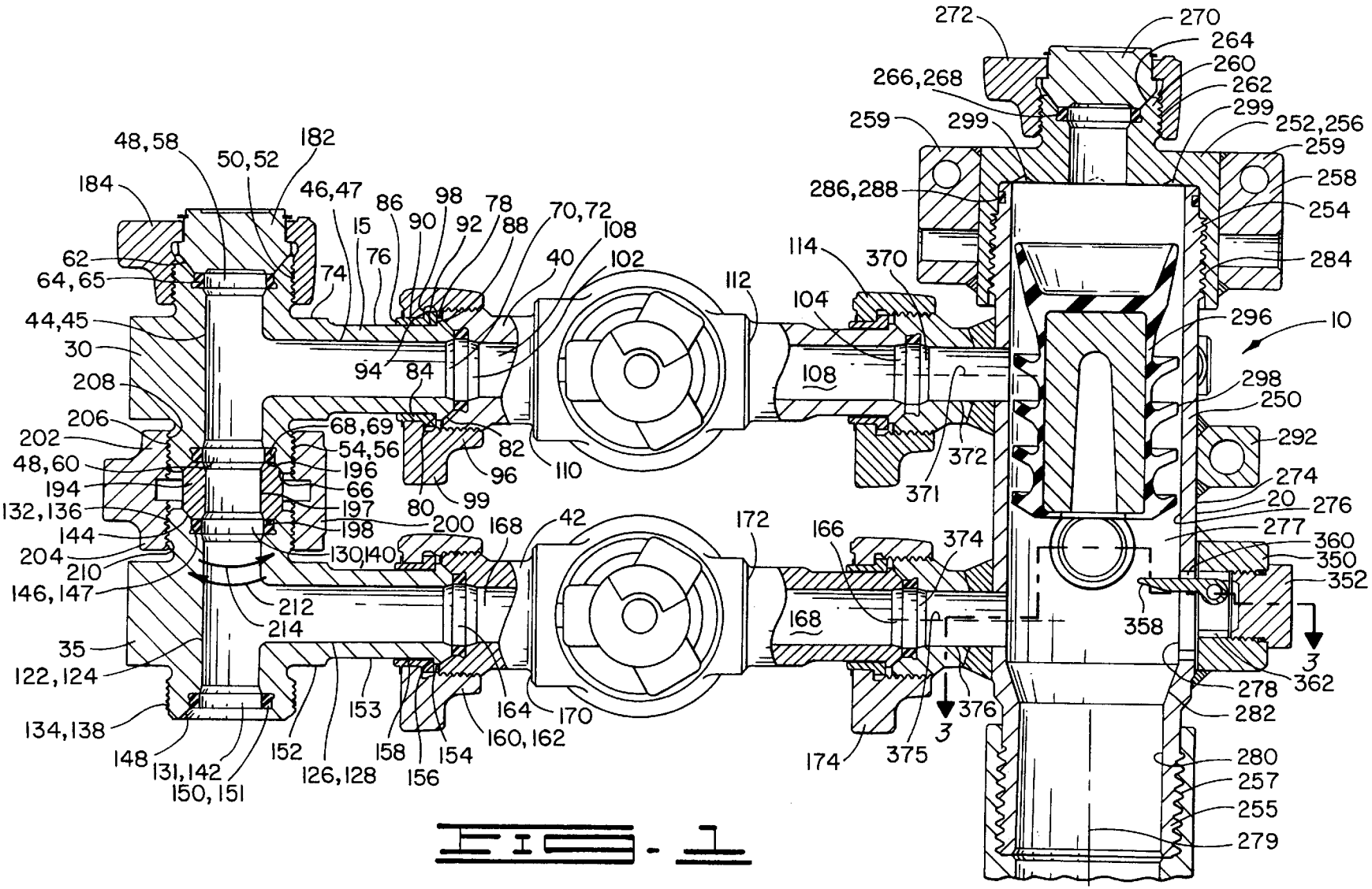
FIG. 1 is a partial sectioned elevation view of a cementing head of the present invention including a plug container and a manifold.
Figure 4:
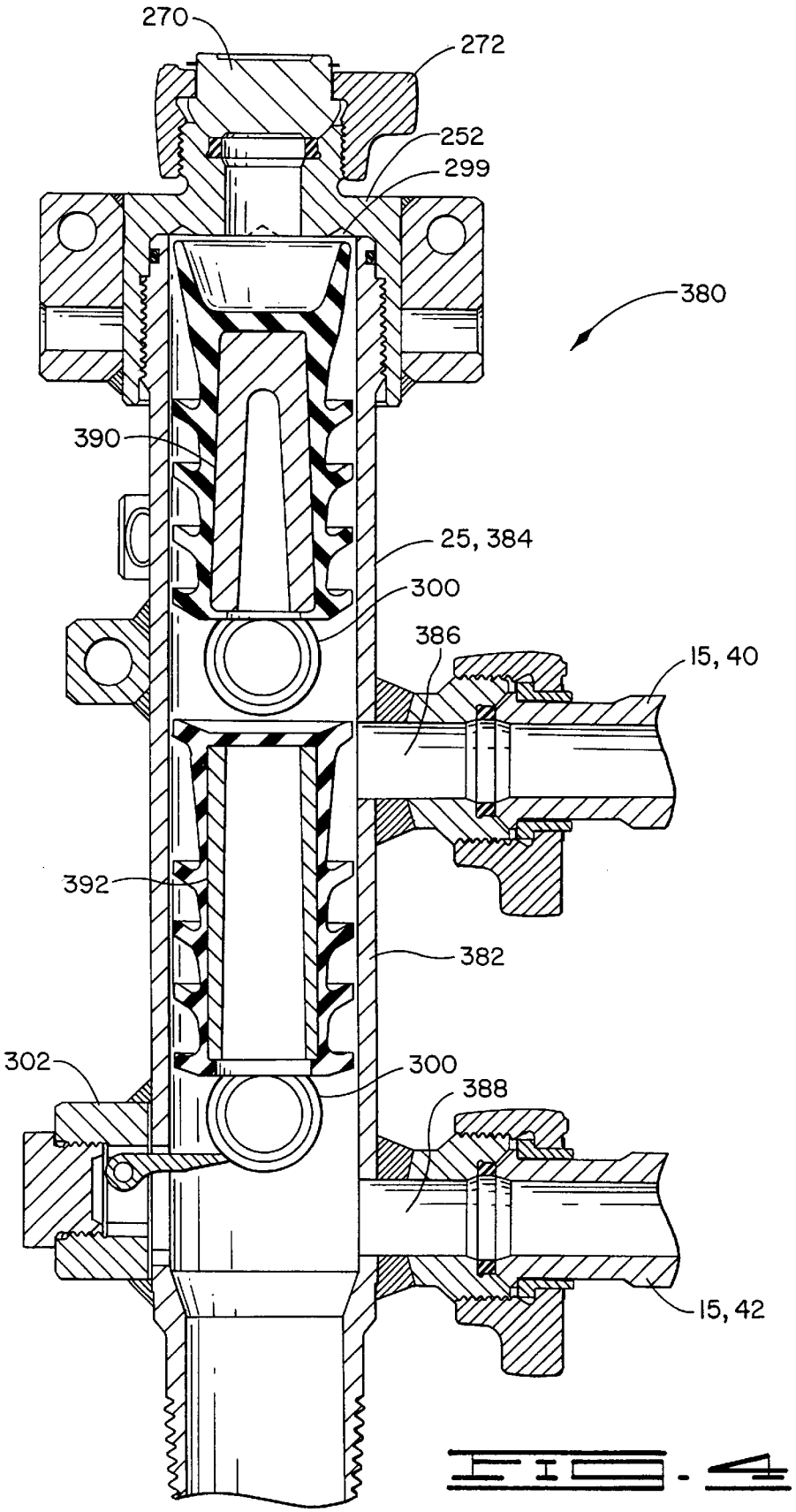
FIG. 4 is a sectioned elevation view of a multiple plug container.

Referring to the figures and more particularly to FIG. 1, a cementing head or cementing apparatus 10 of the present invention comprising a manifold 15 and a plug container 20 is shown. The cementing head 10 described herein may include a multiple plug container 25 as shown in FIG. 4.

Manifold 15 comprises a first or upper discharge tee 30 connected to a second or lower discharge tee 35. First discharge tee 30 is connected to a first or upper valve 40, and second discharge tee 35 is connected to a second or lower valve 42.

Upper discharge tee 30 comprises a run 44 having a bore or opening 45 and a cross or stem 46 having a bore or opening 47 intersecting opening 45. Openings 48 are defined at a first or upper end 50 and a second or lower end 54 of upper discharge tee 30. Threads 52 are defined on the outer surface of upper discharge tee 30 at upper end 50. Threads 56 are defined on the outer surface of second or lower end 54. Openings 48 may comprise upper opening 58 and lower opening 60, and may be referred to as -fluid inlets or fluid outlets depending upon flow direction. In the embodiment shown, the upper opening 58 has been plugged to prevent flow therethrough, and lower opening 60 comprises a fluid inlet. Upper discharge tee 30 has a bevel 62 at the upper end 50 thereof and has a seal groove 64 defined therein below bevel 62. A seal 65 is received in seal groove 64. A bevel 66 is defined at the lower end 54 of upper discharge tee 30. A seal groove 68 having a seal 69 received therein is defined in discharge tee 30 above bevel 66.

Stem 46 of upper discharge tee 30 has a stem end 70 which in the embodiment shown comprises a fluid outlet 72. Stem 46 has a first outer diameter 74, a second outer diameter 76 and a third outer diameter 78. A shoulder 80 is defined by and extends between second and third outer diameters 76 and 78. Bevel 82 is defined at the stem end 70 of stem 46 and is adapted for a typical hammer union connection. Thus, a sleeve 84 is disposed about second outer diameter 76 of stem 46. Sleeve 84 has a first end 86 and a second end 88 which engages shoulder 80. Sleeve 84 has a first outer diameter 90 and a second outer diameter 92. A shoulder 94 is defined by and extends between first and second outer diameters 90 and 92. A threaded nut 96 is disposed about sleeve 84. Shoulder 98 is defined on nut 96 for engaging shoulder 94 such that when nut 96 is threadedly connected to upper valve 40, stem 46 and upper valve 40 will be pulled toward one another.

Upper discharge tee 30 is thus connected by a hammer union connection 99 to upper valve 40 at an inlet 102 thereof. Upper valve 40 further includes an outlet 104. Upper valve 40 may have a cementing flow line 108 extending from both the inlet and outlet sides 110 and 112 of the upper valve 40. Upper valve 40 is adapted to be connected to an upper fluid inlet 370 of the plug container 20 at hammer union connection 114.

Lower discharge tee 35 comprises a run 122 having a bore 124 and a stem or cross 126 having a bore 128 intersecting bore 124. Upper and lower openings 130 and 131 are defined at the first or upper end 132 and second or lower end 134 of run 122. Threads 136 are defined on the outer surface of lower discharge tee 35 at upper end 132 and threads 138 are defined at lower end 134. In the embodiment shown, upper opening 130 comprises a fluid outlet 140 and lower opening 131 comprises a fluid inlet 142. A bevel 144 is defined at upper end 132. A seal groove 146 having a seal 147 received therein is defined in lower discharge tee 35 below bevel 144. A bevel 148 is defined at lower end 134 of run 122 and a seal groove 150 having a seal 151 received therein is defined in lower discharge tee 35 above bevel 148.

The configuration of stem 126 is like that described with reference to upper discharge tee 30. Thus, stem 126 has first, second and third outer diameters 152, 153 and 154, with a shoulder 156 defined between second and third diameters 153 and 154. A sleeve 158 is disposed about second outer diameter 153 and engages shoulder 156. A nut 160 is disposed about sleeve 158 and is adapted to threadedly engage lower valve 42. As noted, the connection to lower valve 42 is a hammer union connection and may be referred to as a hammer union 162. Thus, lower discharge tee 35 is connected to an inlet 164 of lower valve 42 at hammer union connection 162.

Lower valve 42 also has an outlet 166 and may have a flow line 168 extending from the inlet and outlet sides 170 and 172 thereof. Lower valve 42 is adapted to be connected to a lower fluid inlet 374 of plug container 20 at hammer union connection 174.

In the embodiment shown in FIG. 1, a plug 182 blocks upper opening 58 and is held in place by a nut 184 which engages threads 52, to prevent flow therethrough. Lower end 134 of lower discharge tee 35 is adapted to receive a fluid supply line (not shown) which will supply fluid to manifold 15. Upper and lower valves 40 and 42 can be manipulated to selectively provide flow to the upper and lower fluid inlets 370 and 374, respectively, of plug container 20.

A spacer 194 having an upper end 196, a lower end 198 and an opening 197 therethrough may be disposed between upper and lower discharge tees 30 and 35. In the embodiment of FIG. 1, threads 56 on upper discharge tee 30 may be left-hand threads while threads 136 on lower discharge tee 35 are right-hand threads. A closing nut 200, having an upper portion 202, a lower portion 204, and an inner surface 206 engages threads 56 and threads 136. Upper portion 202 has left-hand threads 208 defined on inner surface 206 thereof. Lower portion 204 has right-hand threads 210 defined on inner surface 206. Thus, rotation of closing nut 200 in a first direction 212 will cause upper and lower discharge tees 30 and 35 to close together and engage spacer 194 to create a fluid-tight connection therebetween. Rotation in a second direction 214 will cause upper and lower discharge tees 30 and 35 to move away from one another and increase the space therebetween, so that the manifold 15 can be disassembled.

This is an improvement over prior art manifold constructions in that it allows for a more compact manifold. Prior art manifolds required separate nuts on both the upper and lower discharge tees and had a long changeover nipple therebetween. By providing for a compact manifold, a more compact plug container, as described herein, can be used.

If desired the lower end 54 of the upper discharge tee 30 and the upper end 132 of the lower discharge tee 35 can have threads of different pitches, rather than having left- and right-hand threads. The corresponding closing nut 200 will likewise have threads of different pitches on the upper and lower portions 202 and 204 thereof, such that after the closing nut 200 has been completely threaded onto one discharge tee, it can be rotated to remove it therefrom. The threads on the opposed discharge tee will be defined such that when the closing nut 200 is rotated to remove it from the discharge tee on which it has been engaged, the closing nut 200 will thread onto the opposed discharge tee at a rate such that the space between the two discharge tees will close and tighten around the spacer 194.

Figure 2:
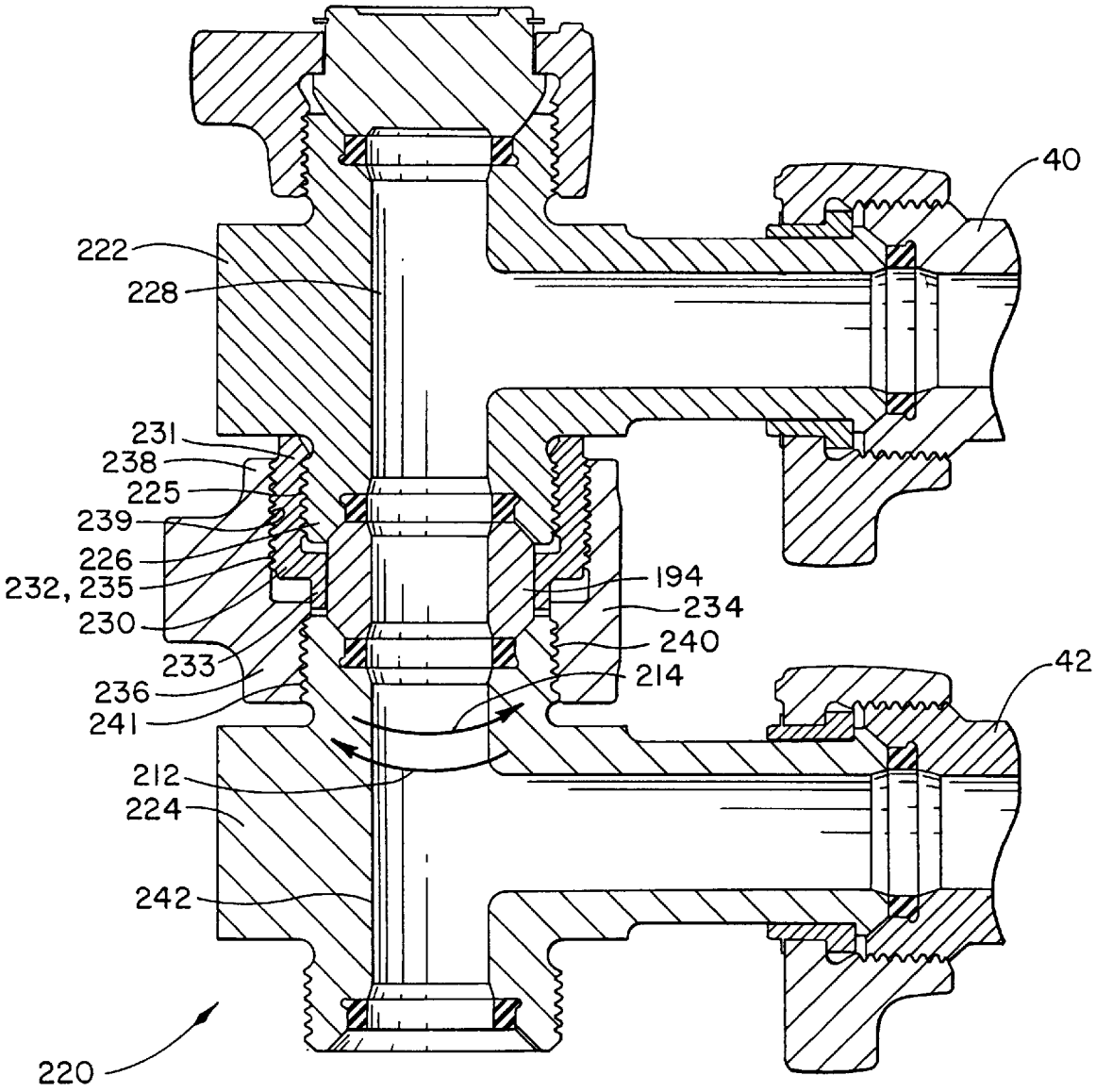
FIG. 2 is a sectioned elevation view of an additional embodiment of a manifold.

In an additional embodiment of a manifold shown in FIG. 2, a bushing is utilized to achieve the same purpose. In the embodiment shown in FIG. 2, only the connection between the upper and lower discharge tees is shown. All other features are identical to that described with respect to manifold 15. Thus, in FIG. 2, a section of a manifold 220 is shown. Manifold 220 has a first or upper discharge tee 222 and a second or lower discharge tee 224. Lower discharge tee 224 is identical to lower discharge tee 35 as described above. Upper discharge tee 222 is likewise identical to upper discharge tee 30 except that threads 225 defined on lower end of 226 of run 228 are right-hand threads 225. Thus, manifold 220 includes a bushing 230 having an upper portion 231 which threadedly engages threads 225 and a lower portion 233 disposed about the spacer 194. Bushing 230 has left-hand threads 232 defined on an outer surface 235 thereof. A closing nut 234 having a lower portion 236 and an upper portion 238 threadedly engages bushing 230.

Upper portion 238 has left-hand threads 239 defined thereon to engage threads 232, and lower portion 236 has right-hand threads 241 defined thereon to engage threads 240 defined on an upper end of run 242 of lower discharge tee 224. Rotation of closing nut 234 in first direction 212 will cause upper and lower discharge tees 222 and 224 to be drawn together to close the space therebetween and to tighten around spacer 194 thereby creating a fluid-tight connection. Rotation in second direction 214 will cause upper and lower discharge tees 222 and 224 to disengage and will increase the space therebetween so that the manifold 220 can be disassembled. If desired, the threads 241 on bushing 232 and the threads 240 on the lower discharge tee 224 can be directionally the same but have different pitches.

In the embodiment of FIG. 1, manifold 15 is shown connected to a single plug container 20. Manifold 15 may also be connected to the multiple plug container 25 as shown in FIG. 4. Plug container 20 comprises a plug container body 250 and a container cap 252 which threadedly engages container body 250 at an upper end 254 thereof. Container body 250 has a lower end 255 having threads 257 defined thereon for engaging a casing string therebelow. Cap 252 includes a cap member 256 having a cap lifting means 258 connected thereto. Cap lifting means 258 may simply comprise lugs 259 having holes defined therethrough for receiving a connection by which the plug container 20 may be lifted.

Cap member 256 has an upper portion 260 having threads 262 defined on the outer surface thereof. Upper portion 260 has a bevel 264 on an inner surface thereof and has a seal groove 266 therebelow with a seal 268 received therein. A plug 270 is disposed in the upper portion 260 of cap 252 and is held in place by a threaded nut 272 which engages threads 262.

Container body 250 is a generally cylindrical member having, outer surface 274 and inner surface 276. Inner surface 276 defines a central opening 277 having a longitudinal central axis 279. Central opening 277 comprises first bore 278 and second bore 280 with a transition bevel 282 therebetween.

Outer surface 274 has threads 284 defined thereon near the upper end 254 of the container body 250 for engaging cap 252. A seal groove 286 is defined in outer surface 274 above threads 284 and has a seal 288 disposed therein for sealingly engaging cap 252.

As is known by those skilled in the art, plug container caps are often removed to load a top plug after the bottom plug has been released and cement has been displaced down the casing. In such instances, the well is on a vacuum and when the cap is removed, air is pulled into the casing. Prior art plug containers have a seal disposed in a groove seal defined in the cap. When such a cap is removed, air can easily pull the O-ring out of the groove and down into the casing. The present arrangement prevents the seal 288 from being moved by air flowing into the plug container 20. The cap 252 has an undercut in front of the internal threads which engages the threads 284 on the container body 250 and lifts the internal threads in the cap 252 over the seal 288 on the container body 250, preventing the internal threads from contacting the seal 288 and possibly cutting it when the cap 252 is made up.

A plurality of makeup lugs 292 are attached to outer surface 270 of container body 250. Because the plug container is often made up on the casing several feet off the rig floor, it must be made up in the casing by hand and tightened with the use of hand-held chain tongs. The outer surface of the plug container is typically a smooth machine finish and chain tongs frequently slip, causing the loss of balance of the person trying to make up the plug container. Makeup lugs 292 allow the use of an operating bar to make up the plug container. This allows the plug container to be made up more quickly and in a manner that is safer for the person making up the plug container and for those on the rig floor.

The embodiment of FIG. 1 shows a plug 296 disposed in container body 250. Plug 296 has an outer diameter 298 smaller than the magnitude of bore diameter 280 so that the plug will pass through container body 250. Cap 252 has drill angle depressions 299 defined therein to prevent a seal from forming between cap 252 and plug 296, so that the plug may be displaced down the casing at the desired time.

Figure 3:
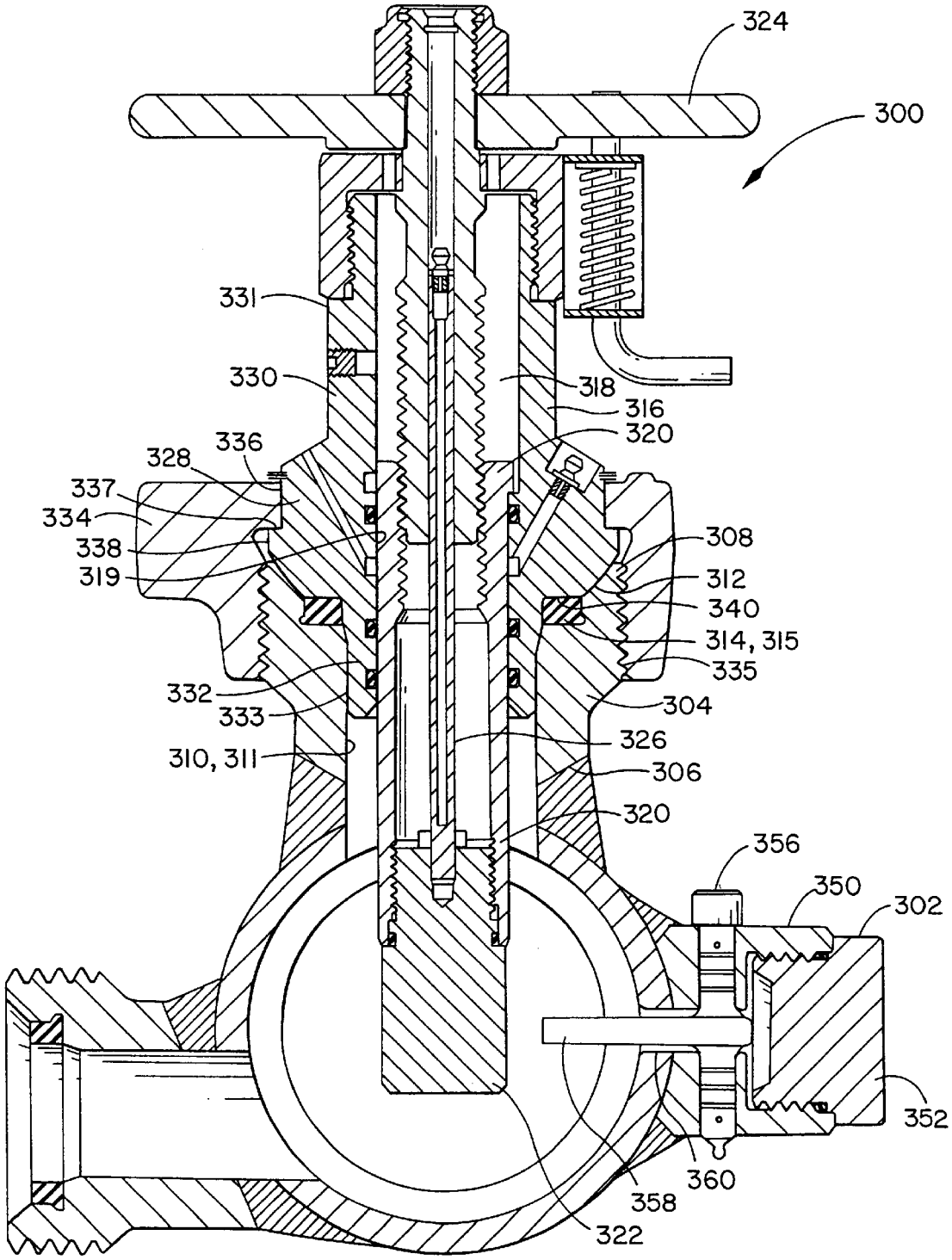
FIG. 3 is a view from line 3—3 of FIG. 1 showing a plunger and indicator assembly in the plug container.

Plug container 20 also includes a plunger assembly 300 and a plug release indicator assembly 302 as shown in FIG. 3. Plunger assembly 300 includes a plunger fitting 304 connected to outer surface 274 of container body 250 by welding or other means. Plunger fitting 304 is connected at first end 306 to container body 250 and has a second end 308. Plunger fitting 304 also has a bore or opening 310 defined by an inner surface 311. A bevel 312 is defined at second end 308. A seal groove 314 is-positioned adjacent bevel 312 and has a seal 315 received therein.

A plunger sleeve 316 is connected to plunger fitting 304. Plunger sleeve 316 defines an opening 318 which includes a bore 319. A plunger pin 320 having a closed end 322 is sealingly received in bore 319 of plunger sleeve 316, and extends into first bore 278 of container body 250. Plunger pin 320 is connected to a handle 324. An indicator pin 326 is disposed in plunger pin 320.

The configuration described herein is similar to prior art plunger assemblies, except that prior art plunger assemblies include a pipe or straight thread which engages the plunger sleeve. In this case, the plunger sleeve 316 is not threaded but instead has a intermediate head portion 328 between an outer portion 330 having an outer diameter 331 and a inner portion 332 having an outer diameter 333 sealingly received in bore 310 of plunger fitting 304.

Intermediate head portion 328 is configured such that the connection between the plunger assembly 300 and the container body 250 is a hammer union connection which uses a wing nut 334 that engages threads 335 on second end 308 of plunger fitting 304. Intermediate head portion 328 has first and second diameters 336 and 338 with a shoulder 337 defined thereby and extending therebetween which is engaged by wing nut 334. When wing nut 334 is threaded on threads 335, an end 340 of intermediate head portion 328 is put into sealing engagement with seal 315. This type of connection allows rapid removal and makeup of the plunger assembly 300 whereas in prior art plunger assemblies which utilize pipe or straight thread connections and O-ring seals, the threads are often difficult and time consuming to make up and can easily be cross-threaded. Although the connection described herein is preferred, any suitable plunger assembly may be utilized.

The plug release indicator 302 comprises a housing 350 having an indicator block plug 352 threaded in the end thereof. An indicator pin 356 extends through housing 350 and has indicator lever 358 connected thereto. Indicator lever 358 extends into first bore 278 of container body 250 through a slot 360. Housing 350 includes an internal cavity 362 which houses indicator pin 356. Indicator block plug 352 has a large diameter plug and has an O-ring seal which when removed provides full access to the internal cavity 362 for maintenance and cleaning. Prior art plug containers typically allow access through a small female pipe thread in the housing.

The container body 250 has a first or upper fluid inlet 370 connected to the outer surface 274 thereof. Upper fluid inlet 370 defines bore 372 which intersects first bore 278 of container body 250. A second or lower fluid inlet 374 having a bore 376 intersecting first bore 278 of container body 250 is also included. First and second inlets 370 and 374 have first and second central axes 371 and 375, respectively. Manifold 15 is connected to plug container 20 at hammer unions 114 and 174 to upper and lower fluid inlets 370 and 374. Thus, upper valve 40 and lower valve 42 are connected to and are in fluid communication with upper and lower fluid inlets 370 and 372.

As shown in FIGS. 1 and 3, upper and lower fluid inlets 370 and 374 are oriented 900 to longitudinal central axis 279 and are substantially tangent to first bore 278. Thus, first and second central axes 371 and 375 are oriented 90° from longitudinal central axis 279 and are offset therefrom. Fluid entering first bore 278 through lower fluid inlet 374 will thus create a flow vortex to pull plug 296 into the flow stream. Upper fluid inlet 370 is positioned beneath the upper end of plug 296 so that fluid entering first bore 278 will be directed against the side of plug 296 and will also create a flow vortex. This insures that the plug 296 will be displaced out of the plug container 20. If the upper fluid inlet 370 were located on the center line of the plug container 20, fluid flow could force the plug 296 against the side of first bore 278 causing it to enter the flow stream later than desired. By locating the upper fluid inlet 370 below the upper end of the plug 296, instead of above the plug 296, a much shorter, lighter and more compact plug container 20 is provided which will accommodate and allow the use of a more compact lightweight manifold 15.

When it is desired to drop plug 296, plunger assembly 300 is actuated so that the closed end 322 thereof is removed from first bore 278 of container body 250. The plug 296 will move indicator lever 358 as it passes therethrough. If desired, cap 252 may be removed in a manner known in the art and a top plug may be placed in the container body 250 and dropped at the desired time.

Because of the location and orientation of lower fluid inlet 374, plug container 20 can be utilized as a free-fall container, or with a manifold 15 as depicted in FIG. 1. If used as a free-fall container, upper fluid inlet 370 is blocked, and a fluid flow line is connected directly to lower fluid inlet 374. When manifold 15 is used, flow is directed first to lower fluid inlet 374. Upper and lower valves 40 and 42 are manipulated to direct flow to upper fluid valve 370 at the desired time to direct the fluid on top of the plug 296 (i.e., cement slurry on top of a bottom plug and a displacing fluid on top of a top plug).

FIG. 4 shows a cementing head 380 comprising a manifold 15 and a multiple plug container 25. Multiple plug container 25 contains all of the features as those described with respect to single plug container 20. Thus, multiple plug container 25 includes a cap 252 and a container body 384 having upper and lower fluid inlets 386 and 388. Upper and lower fluid inlets 386 and 388 are oriented like the upper and lower fluid inlets 370 and 374 described with reference to plug container 20. Container body 384 has a length sufficient to hold an upper plug 390 and a lower plug 392. Multiple plug container 25 includes two plunger assemblies 300, and a plug release indicator 302.

The multiple plug container 25 of the present invention has the same number of fluid inlets as plugs, and thus has only two fluid inlets whereas typically three fluid inlets are included in a multiple plug container. Thus, the cementing head 380 includes a combination free-fall/manifold style plug container 382 which has only two fluid inlets, one located beneath each plug and has no fluid inlet above the upper plug 390. When utilizing the plug container 382 in combination with manifold 15, fluid is directed through lower valve 42 and the lower plunger assembly 300 is retracted to allow lower plug 392 to be displaced down the casing ahead of a cement slurry. Lower valve 42 can then be closed and upper valve 40 can be opened so that cement will be flowing through upper fluid inlet 386 on top of lower plug 392. Once the proper amount of cement has been displaced into the casing, the upper plunger assembly 300 may be retracted from the bore of container body 384. The flow vortex created by fluid entering container body 384 at upper fluid inlet 386 will pull upper plug 390 into the fluid stream. Upper plug 390 will be displaced down the casing string until it engages lower plug 392. If desired, upper fluid inlet 386 may be blocked, and the plug container 382 can be utilized solely as a free-fall container rather than a combination free-fall/manifold plug container.

Because the multiple plug container 25 has only two fluid inlets, and because the upper fluid inlet 386 is located below the upper end of the lower plug 392, the multiple plug container 25 of the present invention is more compact, lightweight and maneuverable than prior art multiple plug containers.

Figure 5A:
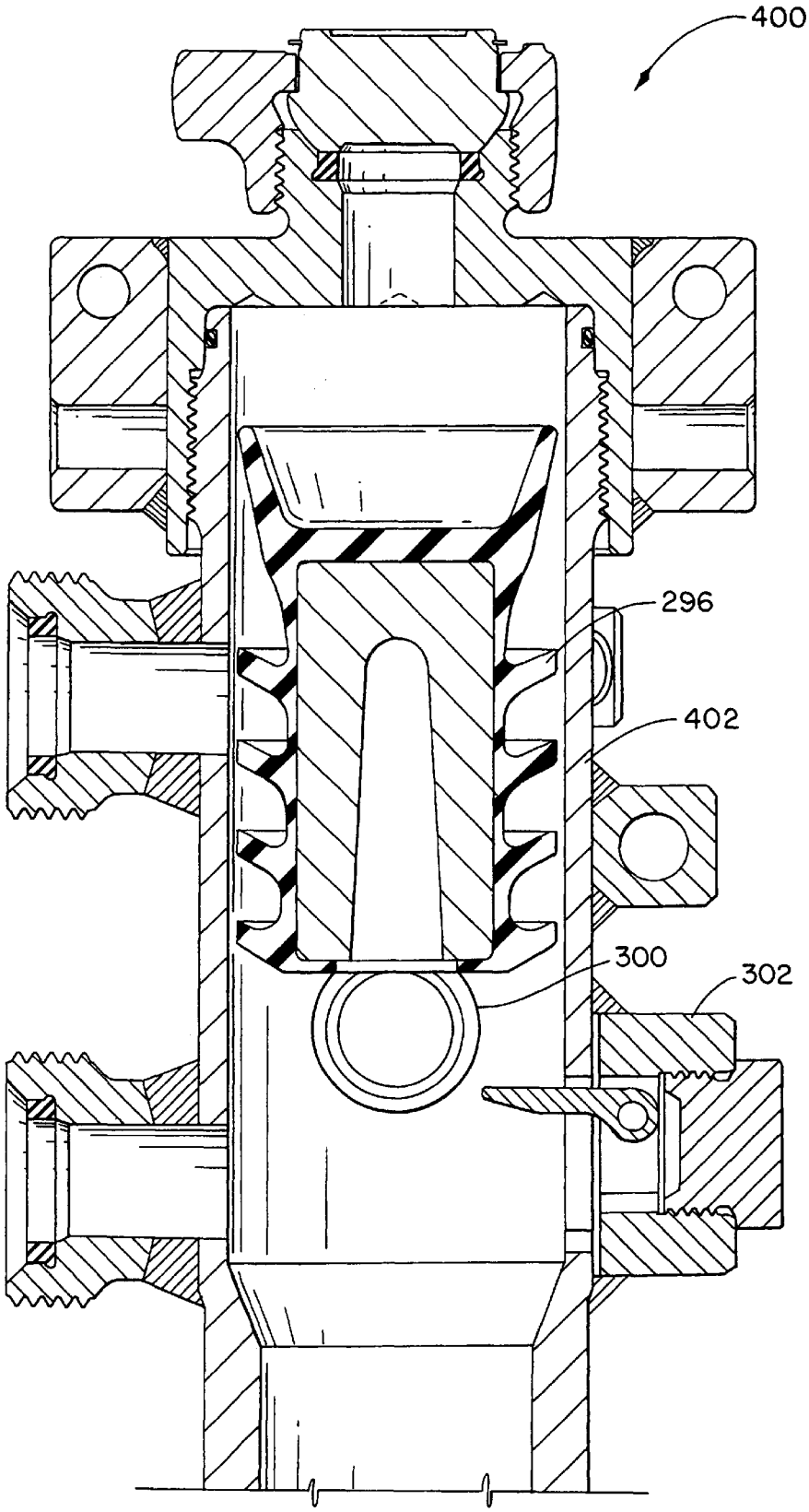
FIGS. 5A and 5B show a sectioned elevation view of cementing head including a plug container and a coupling apparatus.
Figure 5B:
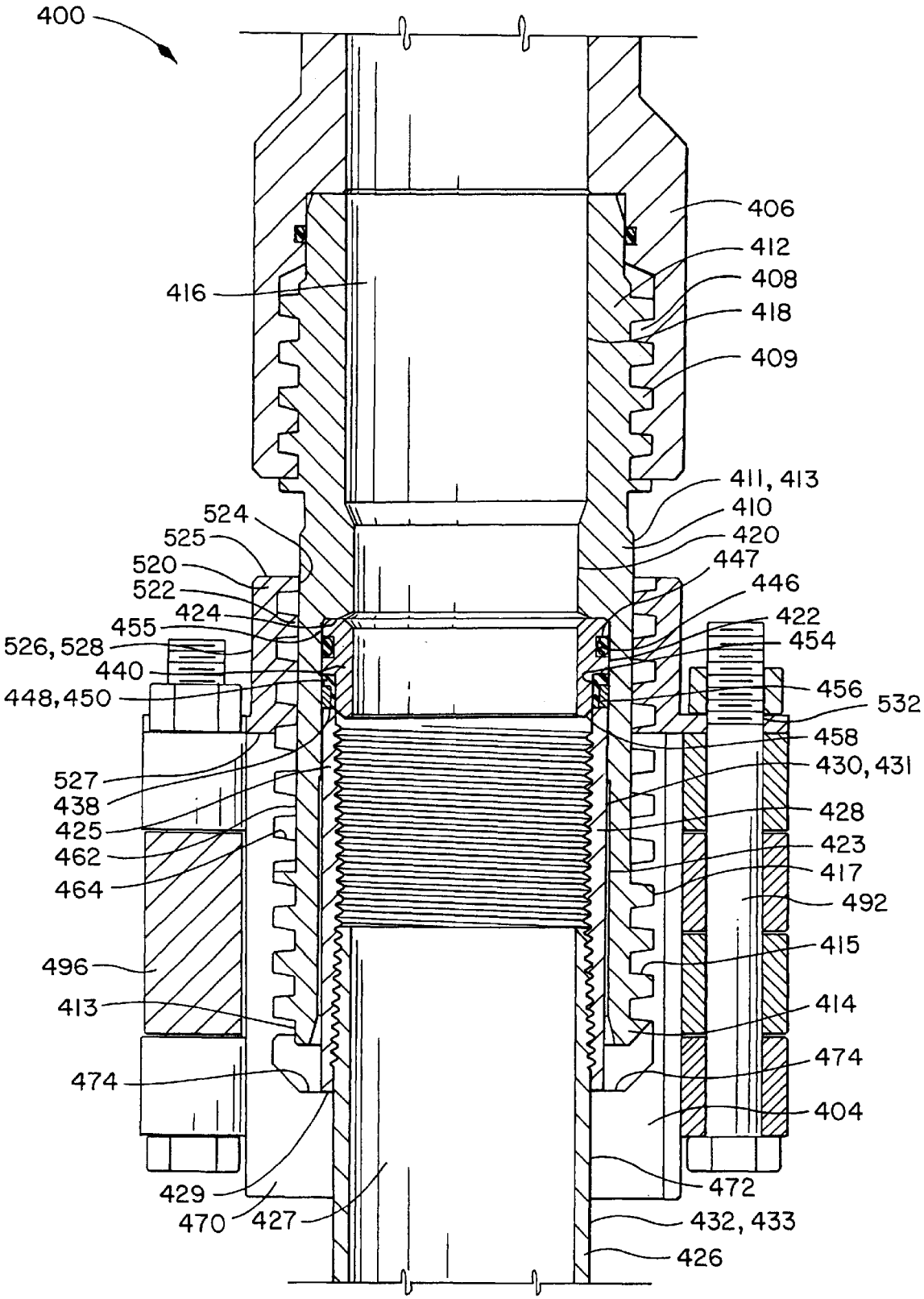
Figure 5:
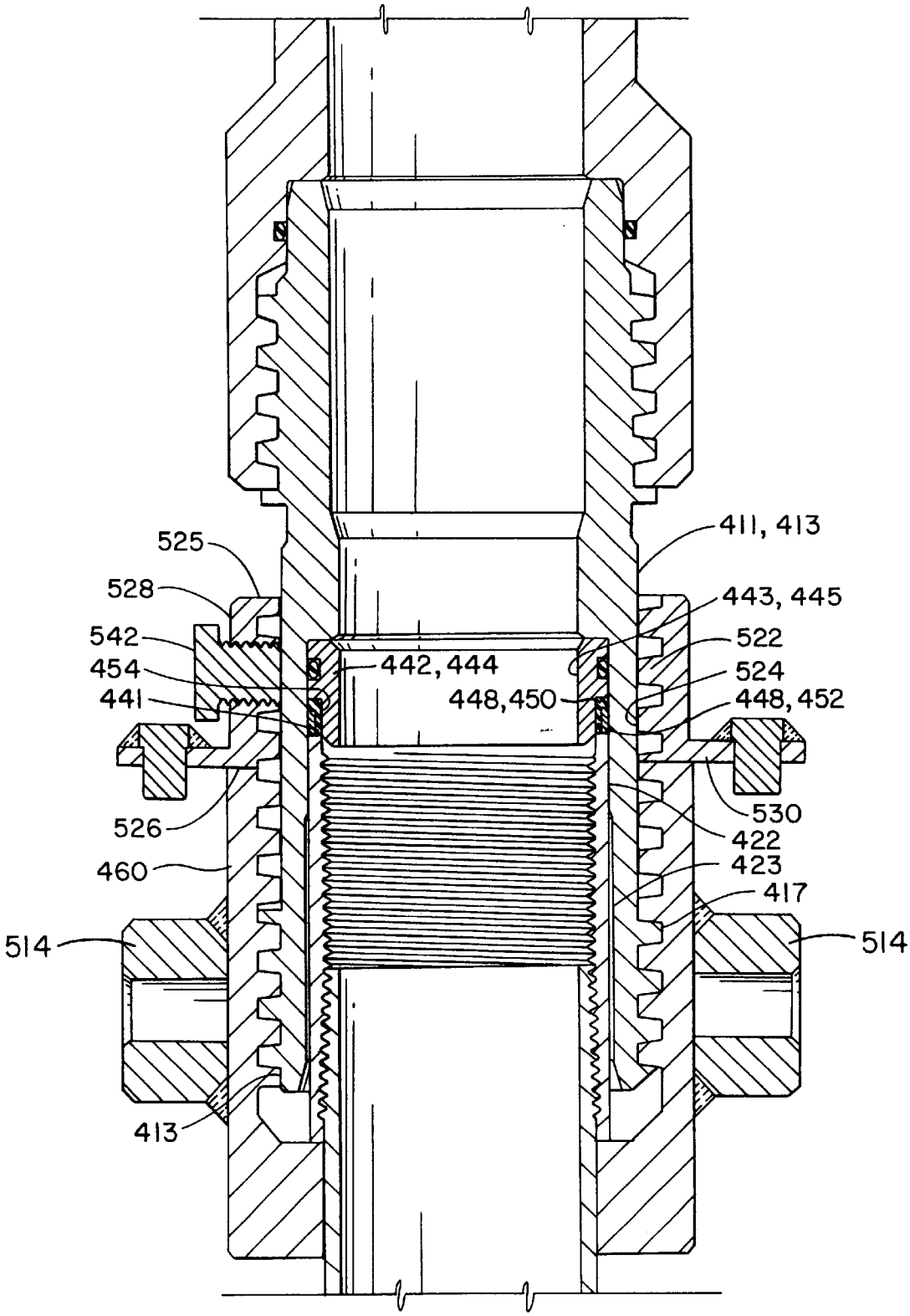

An additional embodiment of a cementing head of the present invention is shown in FIGS. 5A and 5B. Cementing head 400 shown therein includes a plug container 402 having a coupler device or apparatus 404 connected to a lower end 406 thereof Plug container 402 is substantially identical to plug container 20 except, rather than have external threads for direct connection to a casing collar, lower end 406 has internal threads 408 which engage external threads 409 defined on a body 410 of coupler apparatus 404. External threads 409 are defined on an outer surface 411 of body 410 at an upper end 412 thereof. Outer surface 411 defines an outer diameter 413.

Body 410 also includes a lower end 414 and a longitudinal central opening 416 comprised of a first bore 418, a second or intermediate bore 420, a third bore 422 and a fourth bore 423. Outer surface 411 has external threads 415 defined thereon at lower end 414. External threads 415 have an outer diameter 417. Second bore 420 has a diameter smaller than that of third bore 422. A shoulder 424 is defined by and extends between second and third bores 420 and 422 and may be referred to as a downward facing annular shoulder or annular surface 424.

As shown in FIG. 5B, the upper end 425 of a casing string 426 is received in longitudinal central opening 416. Longitudinal flow passage 427 is communicated with longitudinal central opening 416. A casing collar 428 having outer surface 430 defining an outer diameter 431 is disposed at the upper end 425 of casing string 426. A lower end of casing collar 428 defines a downward facing annular surface, or annular end surface 429. Casing string 426 has an outer diameter 432 defined by the outer surface 433 thereof. Outer diameter 431 has a magnitude greater than that of outer diameter 432 and thus extends radially outwardly therefrom. Casing string 426 and casing collar 428 may be referred to as a cylindrical member so that casing collar 428 may be referred to as an enlarged diameter portion of the cylindrical member. An upward facing annular surface or upper annular end surface 438 is defined by casing collar 428. A main seal assembly 440 is sealingly disposed in third bore 422 and seals against annular end surface 438.

Main seal assembly 440 includes a main seal 441 and a hydraulically biased seal carrier 442 as shown in FIG. 6. The seal carrier 442 includes an annular carrier ring 444 having an outer carrier seal 446 disposed in a groove 447 to engage third bore 422 of body 410. Carrier ring 444 has inner surface 443 defining an opening 445. Main seal 441 comprises an annular resilient ring 448 having an L-shaped cross section with a first leg 450 for sealingly engaging third bore 422 and a second leg 452 for sealingly engaging annular end surface 438 of casing collar 428. The annular resilient ring 448 is received in a groove 454 defined by outer surface 455 of carrier ring 444. An anti-extrusion ring 456 engages first and second legs 450 and 452, and third bore 422 to prevent extrusion of the annular resilient ring 448. Carrier ring 444 extends downward longitudinally beyond main seal 441 and has a tapered outer end surface 458 for centering carrier ring 444 relative to the upper end of casing collar 428.

Figure 7:
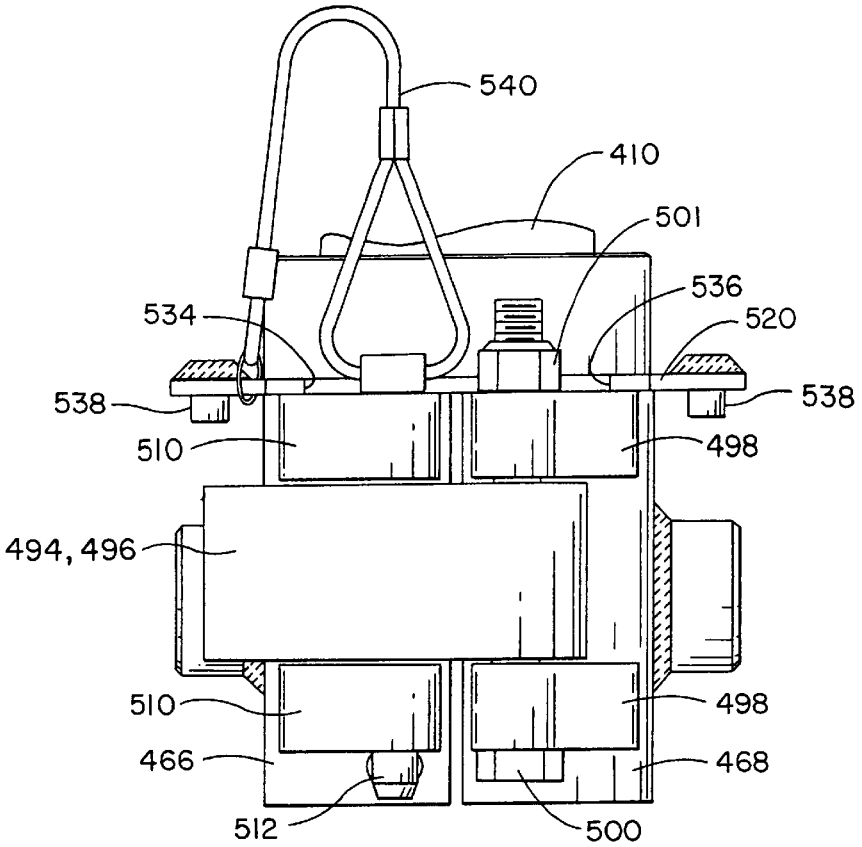
FIG. 7 is a front view of a locking clamp.

Coupler device 404 further includes a locking clamp 460. Locking clamp 460 has internal threads 462 defined on an inner surface 464 thereof for engaging external threads 415 defined at lower end 414 of body 410. Locking clamp 460 is comprised of first and second arcuate clamp portions 466 and 468 each having internal threads 462 defined thereon as shown in FIG. 7. Each of first and second arcuate clamp portions 446 and 468 are preferably integrally formed (i.e., are of one-piece construction) and extend longitudinally from body 410 to below downward facing annular surface 429. Each of first and second arcuate clamp portions 466 and 468 include a radially inwardly extending lip 470 defining a bore 472. Lips 470 define an upward facing shoulder 474 for engaging annular end surface 429 of casing collar 428.

Figure 8:
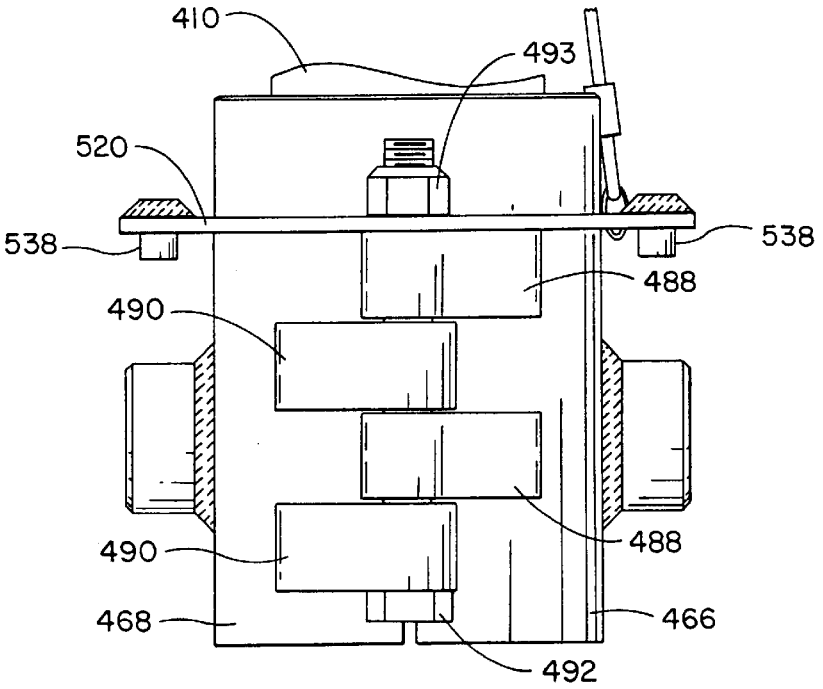
FIG. 8 is a rear view of a locking clamp.
Figure 10:
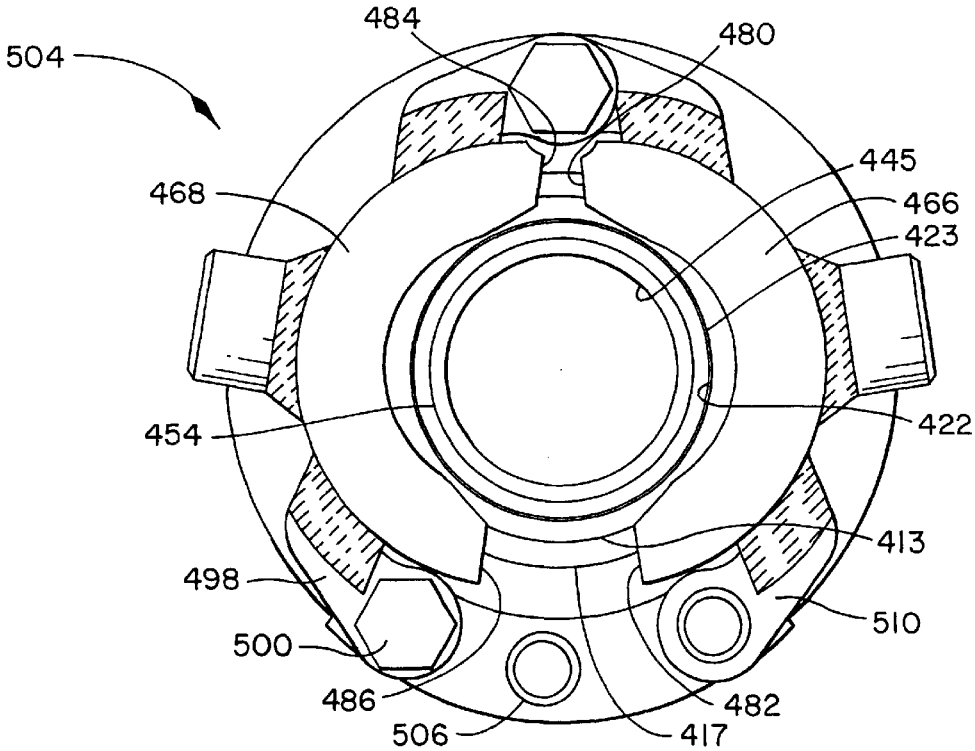
FIG. 10 is a view looking upwardly at a locking clamp in the open position. The casing string is not shown.

First arcuate clamp portion 466 has a first end 480 and a second end 482 as shown in FIG. 10. Second arcuate clamp portion 468 has a first end 484 and a second end 486. As shown in FIG. 8, a pair of hinge pin sleeves 488 are connected to first arcuate portion 466 at the first end 480 thereof, and a pair of hinge pin sleeves 490 are connected to second arcuate clamp portion 468 at the first end 484 thereof A hinge pin 492 is received through hinge pin sleeves 488 and 490 thus hingedly, or pivotally connecting first and second arcuate clamp portions 466 and 468 to one another. Hinge pin 492 may have a nut 493 threadedly received on one end thereof.

Locking clamp 460 also has a latch means 494. Latch means 494 comprises an arcuate latch arm 496 which extends across the space between second ends 482 and 486 of first and second arcuate clamp portions 466 and 468, respectively. Latch means 494 further includes a pair of latch pin sleeves 498 connected to second arcuate clamp portion 468 at the second end 486 thereof. A latch pin 500 is received through latch pin sleeves 498 and arcuate latch arm 496 to connect arcuate latch arm 496 to second arcuate clamp portion 468. Latch pin 500 may be held in place with a nut 501 threaded thereto.

Figure 9:
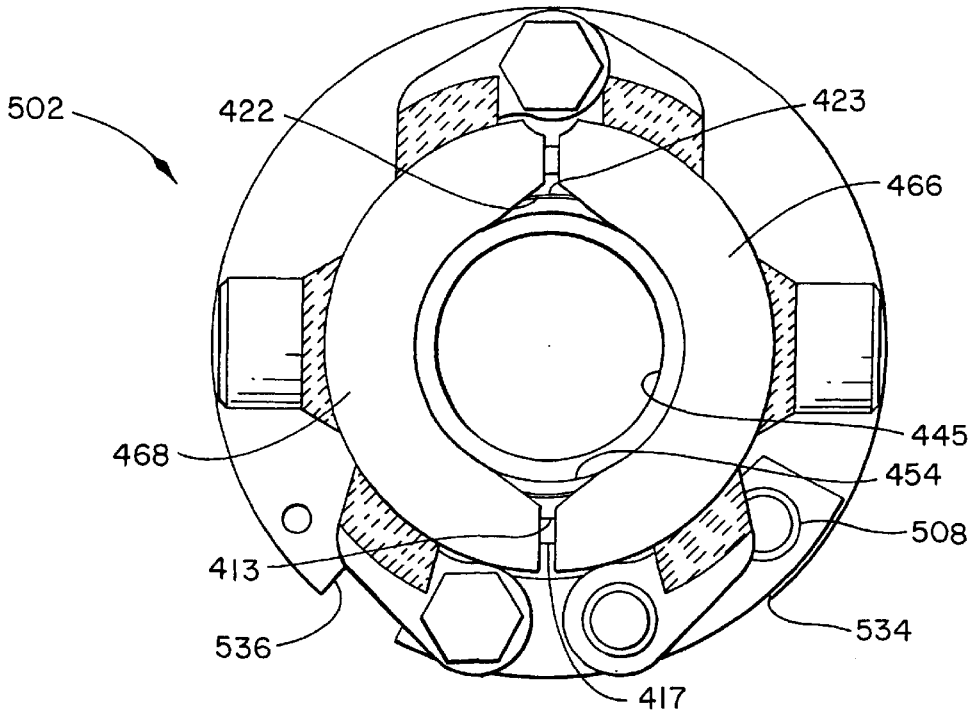
FIG. 9 is a view looking upwardly at a locking clamp in the closed position. The casing string is not shown.

Latch means 494 allows locking clamp 460 to be selectively latched in a closed position 502 and an open position 504 as shown in FIGS. 9 and 10, respectively. Arcuate latch arm 496 thus includes a closed position hole 506 and an open position hole 508. A pair of positioning sleeves 510 are connected to first arcuate clamp portion 466 at the second end 482 thereof. When locking clamp 460 is in closed position 502, a quick release pin 512 is disposed through positioning sleeves 510 and closed position hole 506. To selectively latch locking clamp 460 in the open position 504, the quick release pin 512 is removed from closed position hole 506. The locking clamp 460 may be opened to open position 504 since first and second arcuate clamp portions 466 and 468 will pivot about hinge pin 492. Locking clamp 460 may be latched in open position 504 simply by disposing quick release pin 512 through positioning sleeves 510 and open position hole 508.

Hammer lugs 514 may be welded, or otherwise connected to each arcuate clamp portions 466 and 468. Hammer lugs 514 may be used for opening, closing and otherwise manipulating locking clamp 460.

A limit ring 520 is placed on body 410 above locking clamp 460. Limit ring 520 has internal threads 522 matching external threads 415 on body 410 which allows limit ring 520 to be assembled past external threads 415. Thus, the internal diameter 524 of internal threads 522 is such that the limit ring 520 will slide along the outer surface 411 of body 410 above external threads 415.

Limit ring 520 has upper end 525 and lower end 527 and has an outer surface 526 defining an outer diameter 528. Limit ring 520 includes a lip or shoulder 530 which extends radially outwardly from outer diameter 528. Lip 530 has an orienting hole 532 disposed therethrough. As shown in FIG. 5B, hinge pin 492 is received in orienting hole 532. Lip 530 has first and second ends 534 and 536, and thus does not extend completely around limit ring 520. The portion of limit ring 520 where the lip 530 is absent provides clearance for latch pin sleeves 498, latch pin 500, positioning sleeves 510 and quick release pin 512.

A pair of studs or limit pins 538 are welded to the lip 530. Studs 538 limit the radial movement of arcuate clamp portions 466 and 468, and thus prevent locking clamp 460 from opening too far and insure that internal threads 462 on locking clamp 460 remain engaged with external threads 415 on body 410. Thus, the outer surface of locking clamp 460 on both of arcuate clamp portions 466 and 468 will engage limit pins 538 before locking clamp 460 becomes disengaged from body 410. If desired, a keeper chain 540 may be connected to quick release pin 512 and shoulder 530. A set screw 542 is disposed through limit ring 520 and engages body 410 to hold limit ring 520 in place.

Referring to FIGS. 5A and 5B, the assembly of coupler apparatus 404 is apparent. Plug container 402 is threaded to body 410. Limit ring 520 and locking clamp 460 are threaded onto body 410. The cementing head 400 is then lowered over casing collar 428 so that it is received within longitudinal central opening 416 while locking clamp 460 is in its open position 504. Annular end surface 438 of casing collar 428 will urge the main seal assembly 440 upward and will cause initial compression of main seal 441. Quick release pin 512 is then removed from open position hole 508, and locking clamp 460 is moved to closed position 502. Quick release pin 512 is inserted through positioning sleeves 510 and closed position hole 506. Bore 472 of radially inwardly extending lips 470 is closely received about outer surface 433 of casing string 426 when locking clamp 460 is in closed position 502.

Rotation of locking clamp 460 on external threads 415 will cause casing string 426 to move longitudinally relative to body 410. Thus, the initial compression of main seal 441 may be adjusted by increasing the threaded connection between internal threads 462 on locking clamp 460 and external threads 415 on body 410 which causes upward facing shoulder 474 to engage annular end surface 429 on casing collar 428. Once the desired compression is reached, set screw 542 is rotated to engage body 410, and will prevent any movement of locking clamp 460. Set screw 542 thus comprises a securing means for securing the limit ring 520 to the body 410 and for preventing loosening, or longitudinal movement of locking clamp 460. Additional sealing will be provided once hydraulic pressure is present within the casing string 426 due to hydraulic biasing of the seal carrier 442.

An effective sealing diameter of second leg 452 against annular end surface 438 of casing collar 428, will be somewhere in the mid portion of the annular area of engagement. The effective sealing diameter is less than the inner diameter of third bore 422 so that hydraulic pressure within body 410 will act across an annular differential area of carrier ring 444 thus pushing carrier ring 444 downward and providing a hydraulic bias, biasing the main seal 441 against annular end surface 438 of casing collar 428.

Although the cementing head 400 is shown with a single plug container 402, a multiple plug container may also be connected to a coupling apparatus as described herein. Furthermore, plug containers utilized with the coupler device 404 described herein may be free-fall, or may utilize a manifold.

Additionally, while the embodiment of FIGS. 5A and 5B show a modified square thread at the lower end of the plug container 402, plug containers having a outer male thread like that shown in FIGS. 1 and 2 can be utilized. The body of the coupling apparatus can be adapted by internally threading the upper end thereof or by use of an additional connector.

Figure 11:
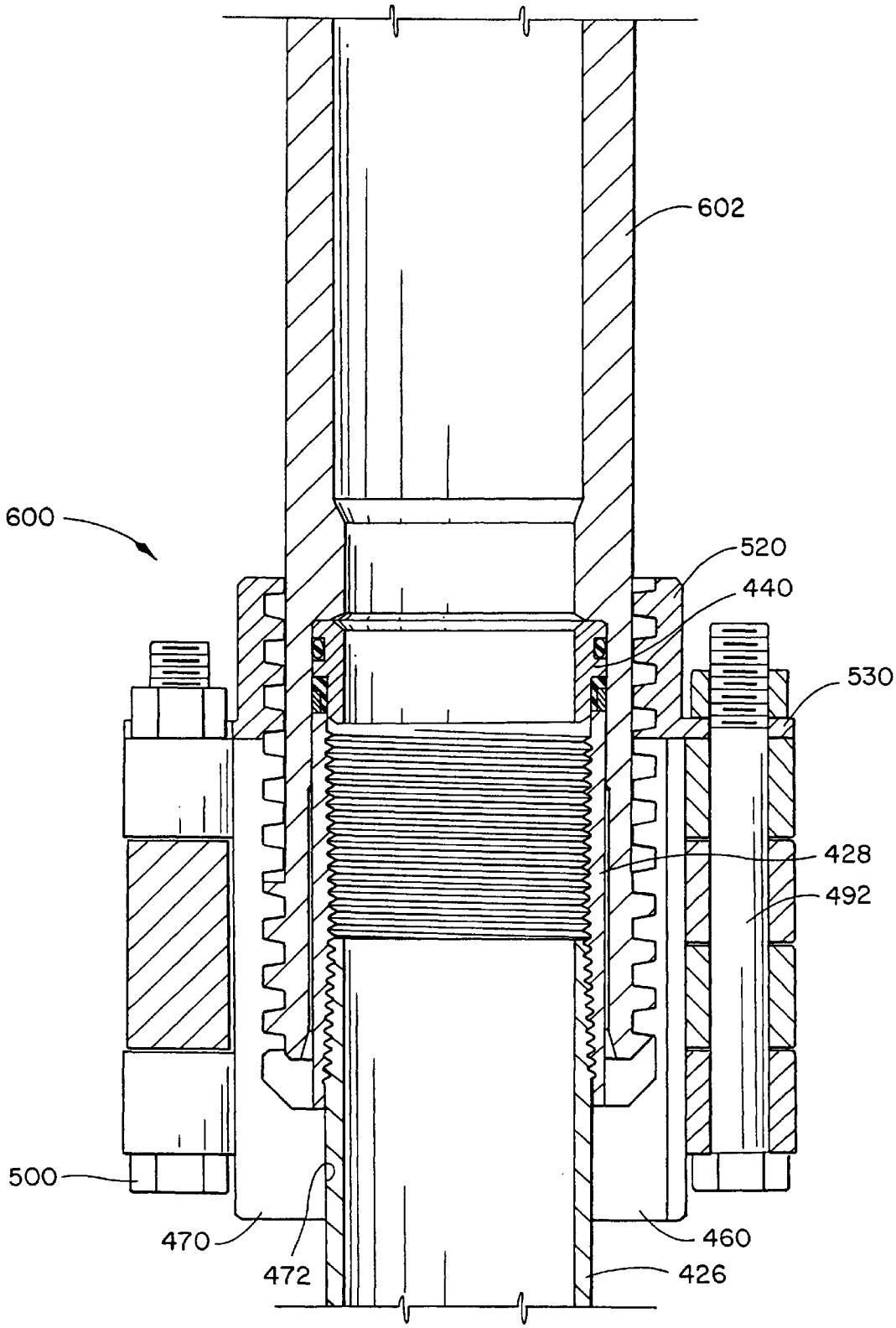
FIG. 11 is a sectioned view of an additional embodiment of a cementing head including a plug container and a coupler apparatus.

An additional embodiment of the cementing head is shown in FIG. 11 and is designated by the numeral 600. Cementing head 600 includes a plug container 602 along with a coupling apparatus which comprises locking clamp 460 and a limit ring 520. The details of the locking clamp 460 and limit ring 520 are as described above. The only distinction between the embodiment shown in FIG. 11 and that shown in FIGS. 5A and 5B is that the body portion of the coupler apparatus is integrally formed with plug container 602. The remaining details of the plug container 602 and coupling apparatus are as previously described herein.

Thus it is seen that the apparatus of the present invention readily achieves the ends and advantages mentioned as well as those inherent therein. While certain preferred embodiments of the present invention have been illustrated for the purposes of this disclosure, numerous changes in the arrangement and construction of parts may be made by those skilled in the art which changes are encompassed within the scope and spirit of this invention as defined by appended claims.

What is claimed is:

1. A coupling apparatus for connecting to a cylindrical member having an enlarged diameter portion, the coupling apparatus comprising:

a body having an inner and outer surface, the outer surface having threads defined thereon, and the inner surface defining a bore through the body;

a seal assembly disposed in the bore of the body for sealing between the body and an upper end surface of the enlarged diameter portion of the cylindrical member;

a limit ring disposed about the body, the limit ring having internal threads; and a locking clamp disposed about the body, the locking clamp comprising:

a first arcuate clamp portion, the first arcuate clamp portion having an inner surface having threads defined thereon, and the first arcuate clamp portion having a radially inwardly extending lip at a lower end thereof for engaging a lower end surface of the enlarged diameter portion of the cylindrical member;

a second arcuate clamp portion, the second arcuate clamp portion having an inner surface having threads defined thereon, and the second arcuate clamp portion having a radially inwardly extending lip at a lower end thereof for engaging the lower end surface of the enlarged diameter portion of the cylindrical member; and a hinge pin for pivotally connecting the first arcuate clamp portion to the second arcuate clamp portion;

wherein, the internal threads on the limit ring allow the limit ring to be assembled past the threads on the body until the limit ring can slide along the outer surface of the body, the first and second arcuate clamp portions threadedly engage the body below a lower end of the limit ring, and the first and second arcuate clamp portions are movable radially between an open position in which the cylindrical member can be received in the locking clamp and a closed position in which the radially extending lips close around the cylindrical member below the lower end surface of the enlarged diameter portion of the cylindrical member.

2. The coupling apparatus of claim 1, wherein rotation of the locking clamp in a first direction when the first and second arcuate clamp portions are in the closed position increases a compression of a main seal disposed in the seal assembly, and rotation of the locking clamp in a second direction when the first and second arcuate clamp portions are in the closed position decreases the compression of the main seal.

3. The coupling apparatus of claim 2, wherein the enlarged diameter portion of the cylindrical member comprises a casing collar.

4. The coupling apparatus of claim 3, wherein the body extends downward from a plug container.

5. The coupling apparatus of claim 4, wherein the body is integrally formed with the plug container.

6. The coupling apparatus of claim 1, wherein the locking clamp abuts the lower end of the limit ring when the first and second arcuate clamp portions are in the closed position.

7. The coupling apparatus of claim 6, further comprising securing means for securing the limit ring to the body so that the limit ring prevents longitudinal movement of the locking clamp with respect to the body, wherein a desired compression of the main seal is maintained.

8. The coupling apparatus of claim 7, wherein the securing means comprises a set screw.

9. The coupling apparatus of claim 1, wherein the limit ring limits the radial movement of the first and second arcuate clamp portions.

* * * * *